US007726784B2

(12) United States Patent
Kajiura et al.

(10) Patent No.: US 7,726,784 B2
(45) Date of Patent: Jun. 1, 2010

(54) LIQUID EJECTION HEAD

(75) Inventors: Morimasa Kajiura, Ichinomiya (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 92 days.

(21) Appl. No.: 12/035,026

(22) Filed: Feb. 21, 2008

(65) Prior Publication Data

US 2008/0204522 A1 Aug. 28, 2008

(30) Foreign Application Priority Data

Feb. 23, 2007 (JP) ..... 2007-043919

(51) Int. Cl.
*B41J 2/045* (2006.01)
*B41J 2/05* (2006.01)

(52) U.S. Cl. ..... 347/72; 347/65

(58) Field of Classification Search ..... 347/72
See application file for complete search history.

(56) References Cited

U.S. PATENT DOCUMENTS

| | | | | |
|---|---|---|---|---|
| 6,604,817 | B2 | 8/2003 | Isono et al. | |
| 2002/0105567 | A1 | 8/2002 | Yamada et al. | |
| 2005/0036010 | A1* | 2/2005 | Terakura et al. | 347/71 |
| 2006/0284940 | A1* | 12/2006 | Katayama | 347/72 |

FOREIGN PATENT DOCUMENTS

| | | | |
|---|---|---|---|
| EP | 1506865 | A | 2/2005 |
| JP | 2001246744 | B2 | 9/2001 |
| JP | 2006-076128 | A | 3/2006 |
| JP | 2006-347123 | A | 12/2006 |

OTHER PUBLICATIONS

Japanese Patent Office, Office Action issued in corresponding Japanese Application No. 2007-043919, dated Feb. 3, 2009.
European Patent Office, European Search Report for Related EP Application No. 08003198 dated May 29, 2008.

* cited by examiner

*Primary Examiner*—Matthew Luu
*Assistant Examiner*—Lisa M Solomon
(74) *Attorney, Agent, or Firm*—Baker Botts, LLP.

(57) ABSTRACT

A liquid ejection head according to one aspect of the invention comprises: a channel unit that comprises: a plurality of individual liquid channels each including a pressure chamber; and a first surface having a plurality of openings corresponding to a plurality of the pressure chambers; and a piezoelectric actuator unit having a second surface that is bonded to the first surface of the channel unit via an adhesive to cover the plurality of pressure chambers. One or more grooves are formed in the first surface of the channel unit to surround the plurality of pressure chambers. An outer edge portion of the second surface the piezoelectric actuator unit faces the groove. A supporting portion that faces the outer edge portion of the second surface of the piezoelectric actuator unit to support the piezoelectric actuator unit is provided in the groove.

12 Claims, 13 Drawing Sheets

LIQUID EJECTION HEAD

CROSS-REFERENCE TO RELATED APPLICATIONS

This application is based upon and claims the benefit of priority from Japanese Patent Application No. 2007-043919, filed on Feb. 23, 2007, the entire contents of which are incorporated herein by reference.

TECHNICAL FIELD

The present invention relates to a liquid ejection head, and more specifically, to a liquid ejection head in which a channel unit and an actuator unit are bonded via an adhesive.

BACKGROUND

JP-B-3692895 (e.g., FIG. 4) discloses an ink-jet head including a piezoelectric actuator (piezoelectric actuator unit) stacked on one flat surface of a cavity plate that serves as a channel unit in which pressure chambers are opened. On a side surface of the piezoelectric actuator, a side electrode that is used to electrically connect a driving electrode formed on a top surface of the actuator to an external wiring line is formed. According to this configuration, the side electrode may be short-circuited from the metallic cavity plate becomes high. Therefore, in the ink-jet head of JP-B-3692895, the electric short circuit between the side electrode and the cavity plate is prevented by forming a recessed portion in the top surface of the cavity plate, and separating the side electrode the cavity plate from each other with the recessed portion therebetween.

When the ink-jet head described of JP-B-3692895 is manufactured, generally, the piezoelectric actuator is pressed against the top surface of the cavity plate after an adhesive is applied to the top surface of the cavity plate. In that case, a recessed portion formed in the top surface of the cavity plate also functions as a relief groove of the adhesive. That is, the adhesive overflowing from between the cavity plate and the piezoelectric actuator is accommodated in the recessed portion. Therefore, it is possible to prevent poor ejection caused when the adhesive climbs up the side surface of the piezoelectric actuator and adheres to the top surface of the piezoelectric actuator.

However, when the piezoelectric actuator is pressed against the top surface of the cavity plate in manufacturing the ink-jet head of JP-B-3692895, cracks may be generated in a region in the vicinity of an outer edge of the piezoelectric actuator. This is because the region in the vicinity of the outer edge of the piezoelectric actuator that faces the recessed portion is not supported by the cavity plate, and therefore, a pressing force applied to the region in the vicinity of the outer edge acts on the piezoelectric actuator as a shear force. When cracks are generated in the piezoelectric actuator, ink may be ejected poorly or cannot be ejected.

SUMMARY

One aspect of the invention provides an object to an ink-jet ejection head that makes cracks hardly generated in a piezoelectric actuator unit when the piezoelectric actuator unit is boned to a channel unit via an adhesive.

According to an aspect of the invention, there is provided a liquid ejection head comprising: a channel unit that comprises: a plurality of individual liquid channels each including a pressure chamber; and a first surface having a plurality of openings corresponding to a plurality of the pressure chambers; and a piezoelectric actuator unit having a second surface that is bonded to the first surface of the channel unit via an adhesive to cover the plurality of pressure chambers, wherein one or more grooves are formed in the first surface of the channel unit to surround the plurality of pressure chambers, wherein an outer edge portion of the second surface the piezoelectric actuator unit faces the groove, and wherein a supporting portion that faces the outer edge portion of the second surface of the piezoelectric actuator unit to support the piezoelectric actuator unit is provided in the groove.

DESCRIPTION

Hereinafter, illustrative, non-limiting embodiments of the invention will be described with reference to the drawings.

First Embodiment

Figure 1:
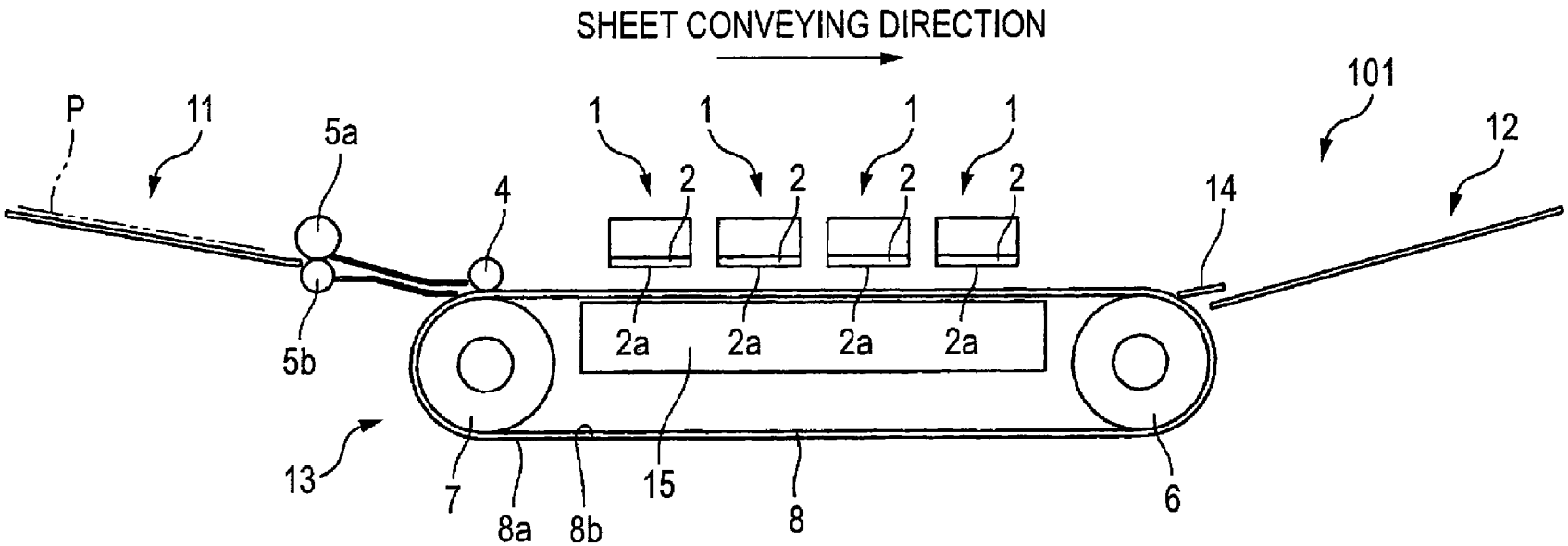
FIG. 1 is an appearance side view of an ink-jet head according to a first embodiment of the invention.

FIG. 1 is a schematic side view showing the overall configuration of an ink-jet printer that is a first embodiment according to the invention. As shown in FIG. 1, an ink-jet printer 101 is a color ink-jet printer that has four ink-jet heads 1. In this ink-jet printer 101, a sheet feed unit 11 is provided on the left in the drawing, and a sheet discharge unit 12 is provided on the right in the drawing.

A sheet conveying path along which a sheet (recording medium) P is conveyed toward the sheet discharge unit 12 from the sheet feed unit 11 is formed inside the ink-jet printer 101. A pair of feed rollers 5*a* and 5*b* that nip and convey a sheet are disposed immediately downstream of the sheet feed unit 11. The pair of feed rollers 5*a* and 5*b* are provided to deliver a sheet P to the right in the drawing from the sheet feed unit 11. An intermediate portion of the sheet conveying path is provided with a belt conveyor mechanism 13 including two belt rollers 6 and 7, an endless conveyor belt 8 that is wound so as to be laid between both the rollers 6 and 7, and a platen 15 that is disposed in a position that faces the ink-jet heads 1 in a region surrounded by the conveyor belt 8. The platen 15 supports the conveyor belt 8 so that the conveyor belt 8 may not be flexed downward in the region that faces the ink-jet heads 1. A nip roller 4 is disposed in a position that faces the belt roller 7. The nip roller 4 presses a sheet P that is delivered by the feed rollers 5*a* and 5*b* from the sheet feed unit 11, against an outer peripheral surface 8*a* of the conveyor belt 8.

As a conveying motor that is not shown rotates the belt roller 6, the conveyor belt 8 is driven. Thereby, the conveyor belt 8 conveys a sheet P pressed against the outer peripheral surface 8*a* by the nip roller 4 toward the sheet discharge unit 12 while adhesively holding the sheet.

A separating mechanism 14 is provided immediately downstream of the conveyor belt 8 along the sheet conveying path. The separating mechanism 14 is configured so as to separate a sheet P, which is adhered to the outer peripheral surface 8*a* of the conveyor belt 8, from the outer peripheral surface 8*a*, to feed the sheet toward the sheet discharge unit 12 on the right in the drawing.

The four ink-jet heads 1 are arranged along the conveying direction in correspondence with four kinds of color inks (magenta, yellow, cyan, and black). That is, this ink-jet printer 101 is a line type printer. Each of the four ink-jet heads 1 has a head unit 2 at its lower end. The head unit 2 is formed in the shape of a slender rectangular parallelepiped that is relatively long in a direction orthogonal to the conveying direction. Further, the bottom surface of the head unit 2 is an ink ejection surface 2*a* that faces the outer peripheral surface 8*a*. When a sheet P conveyed by the conveyor belt 8 passes through the portions immediately below the four head units 2 in order, each color ink is ejected toward the top surface, i.e., printing surface of the sheet P from the ink ejection surface 2*a* so that a desired color image can be formed on the printing surface of the sheet P.

Figure 2:
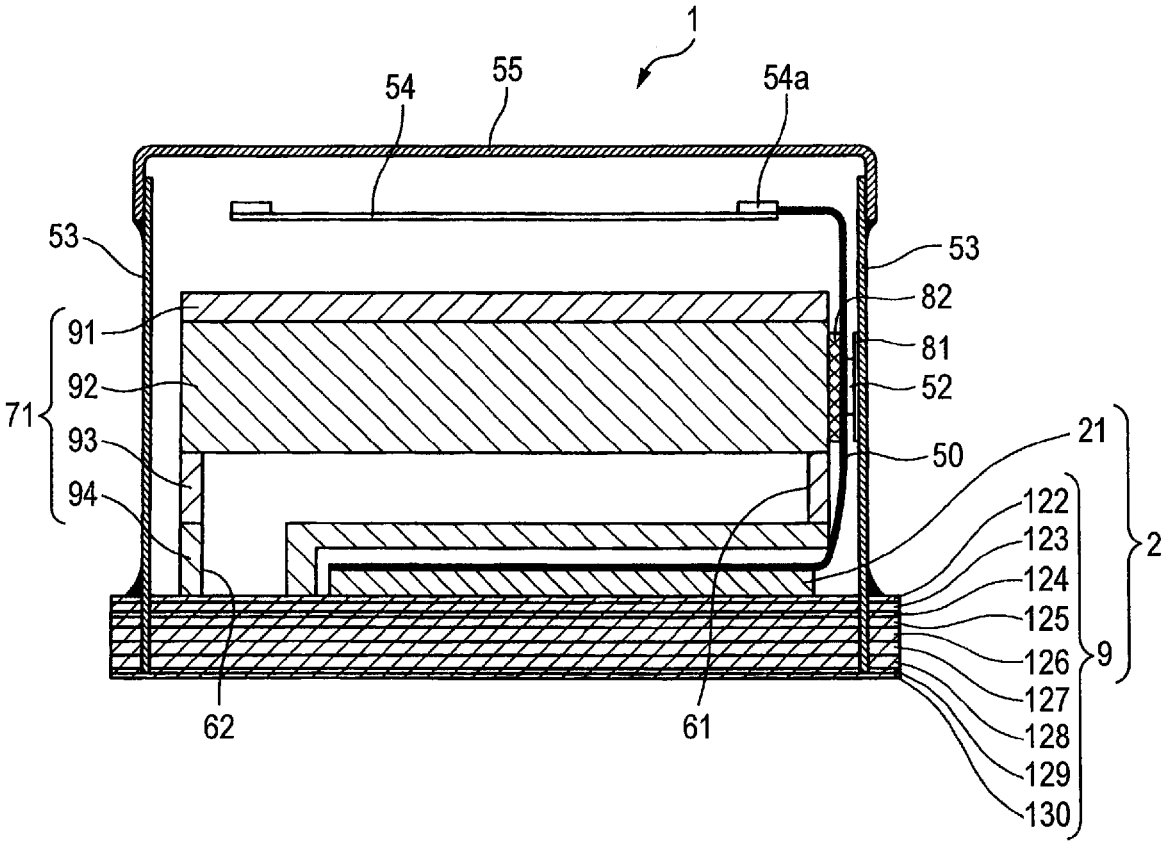
FIG. 2 is a cross-sectional view of the ink-jet head shown in FIG. 1 along its width direction.

Next, an ink-jet head 1 will be described in detail referring to FIG. 2. FIG. 2 is a cross-sectional view of the ink-jet head 1 along its width direction. As shown in FIG. 2, the ink-jet head 1 has a head unit 2 in which a channel unit 9 and four actuator units 21 are bonded via an adhesive at the lower portion of the ink-jet head 1. A reservoir unit 71 that supplies ink to the head unit 2 is fixed to a top surface of the head unit 2. A vicinity of one end of a COF (Chip On Film) 50 is fixed to a top surface of the actuator unit 21. The COF 50 is a flat flexible substrate on which a driver IC 52 is mounted. The other end of the COF 50 is electrically connected to a control board 54. The control board 54 controls driving of the actuator units 21 via the driver IC 52. The driver IC 52 generates a driving signal that drives the actuator units 21.

The four actuator units 21, the reservoir unit 71, the COF 50, and the control board 54 are covered with side covers 53 and a head cover 55. The side covers 53 that are metal plates are fixed to vicinities of both ends of a top surface of the channel unit 9 in its width direction, and extend along a longitudinal direction of the channel unit 9. The head cover 55 is fixed to upper ends of the two side covers 53 so as to be laid between them.

The reservoir unit 71 is formed by laminating four plates 91 to 94 on each other, and an ink inflow channel that is not shown, an ink reservoir 61, and ten ink outflow channels 62 are formed inside the reservoir unit so as to communicate with one another. In addition, only one ink outflow channel 62 is shown in FIG. 2. Ink from an ink tank that is not shown flows into the ink inflow channel. The ink reservoir 61 communicates with the ink inflow channel and the ink outflow channels 62, and reserves ink temporarily. The ink outflow channels 62 communicate with the channel unit 9 via ink supply ports 105*b* (see FIG. 3) formed in the top surface of the channel unit 9. The ink from the ink tank passes through the ink inflow channel, the ink reservoir 61, and the ink outflow channels 62, and is supplied to the channel unit 9 via ink supply ports 105*b*. A bottom surface of the plate 94 is formed as a concave-convex surface so that a gap may be formed between the plate 94 and the COF 50.

The COF 50 extends while being sandwiched between one side cover 53 and the reservoir unit 71. The other end of the COF 50 is electrically connected to a connector 54*a* mounted on the control board 54. The driver IC 52 is biased against the side cover 53 by a sponge 82 pasted on the side surface of the reservoir unit 71.

Figure 3:
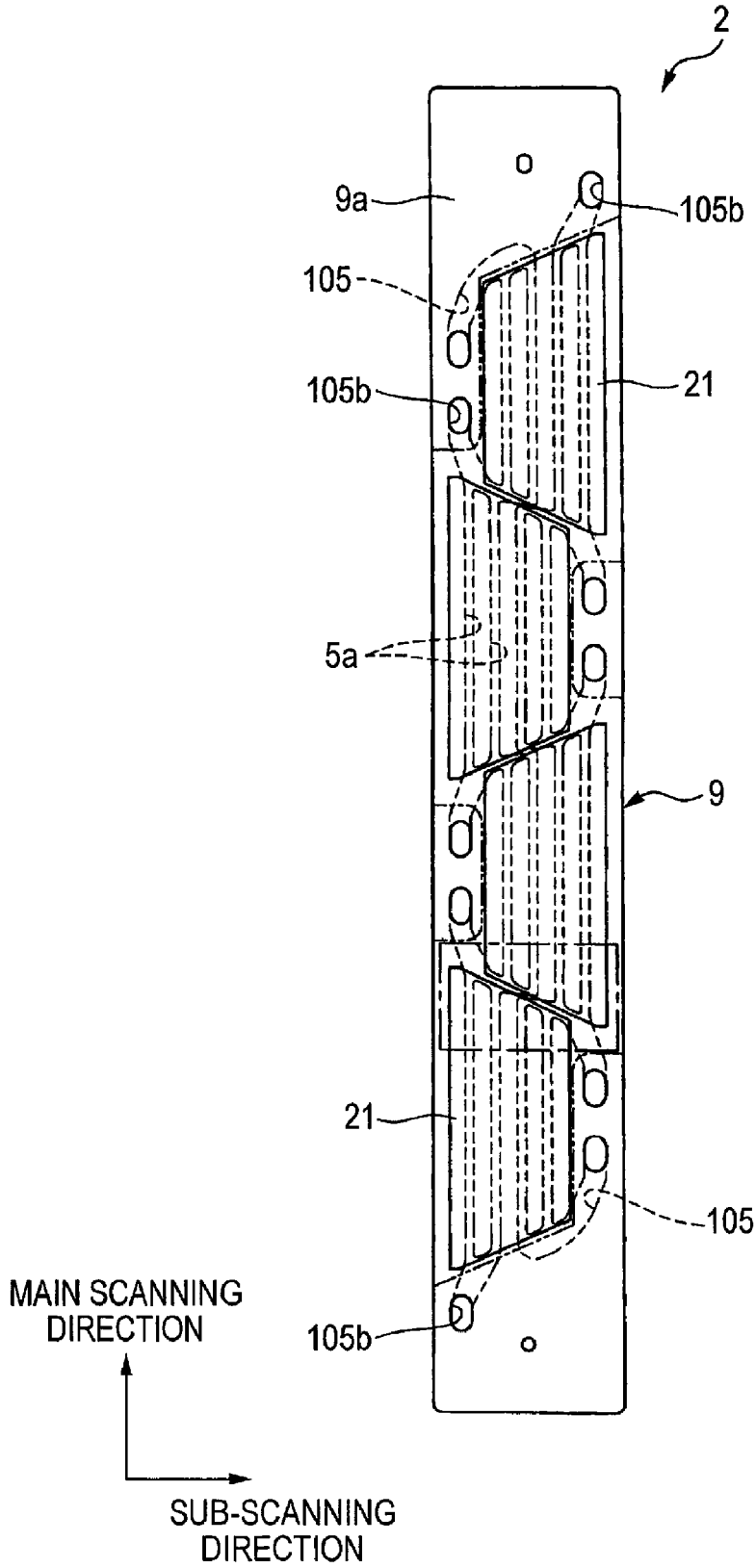
FIG. 3 is a plan view of a head unit shown in FIG. 2.
Figure 4:
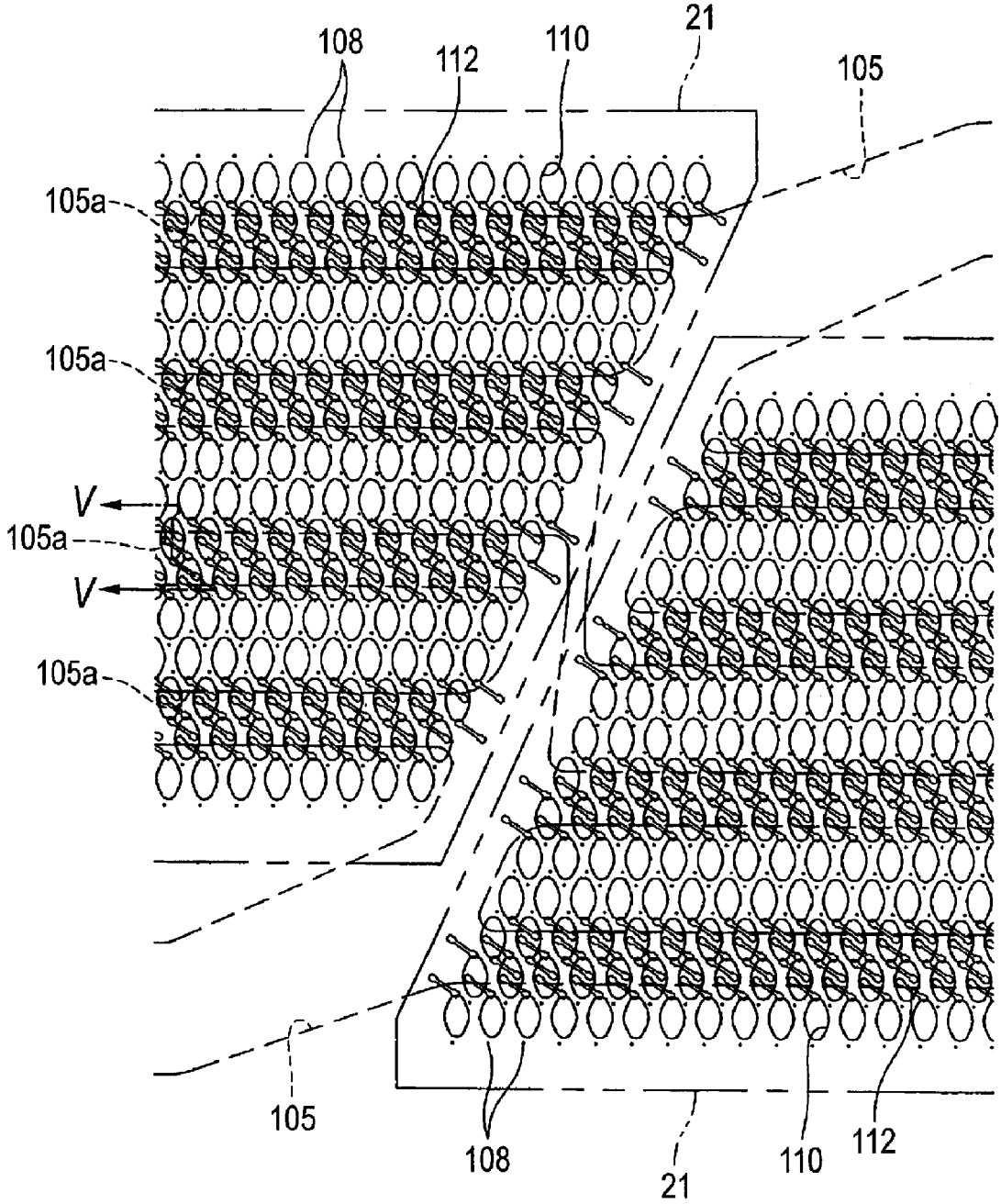
FIG. 4 is an enlarged view of a region surrounded by one-dot chain lines shown in FIG. 3.
Figure 5:
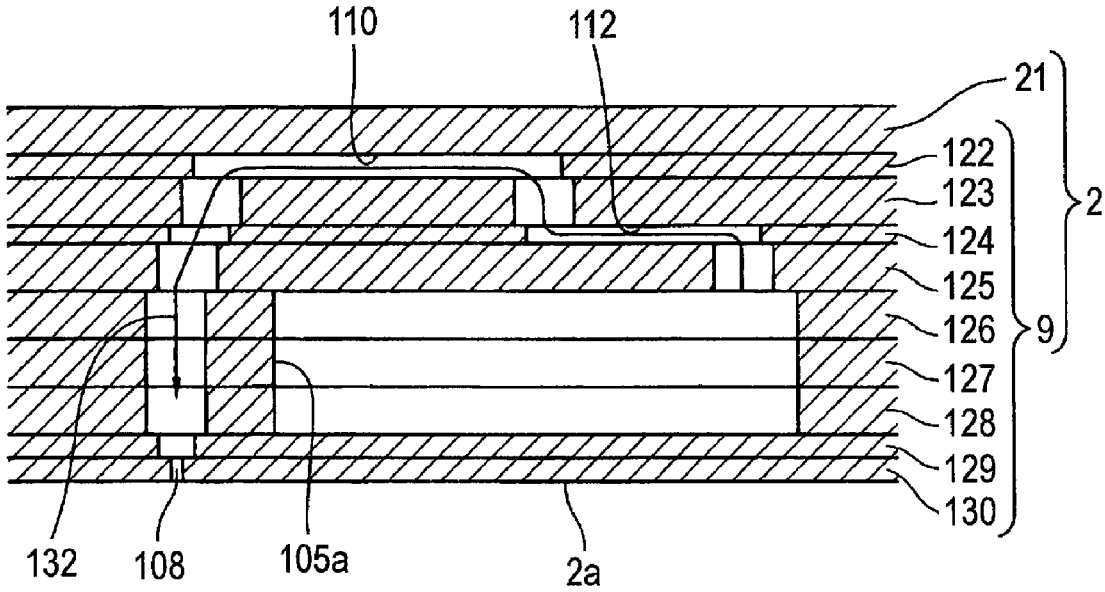
FIG. 5 is a cross-sectional view taken along the line V-V of FIG. 4.
Figure 6A:
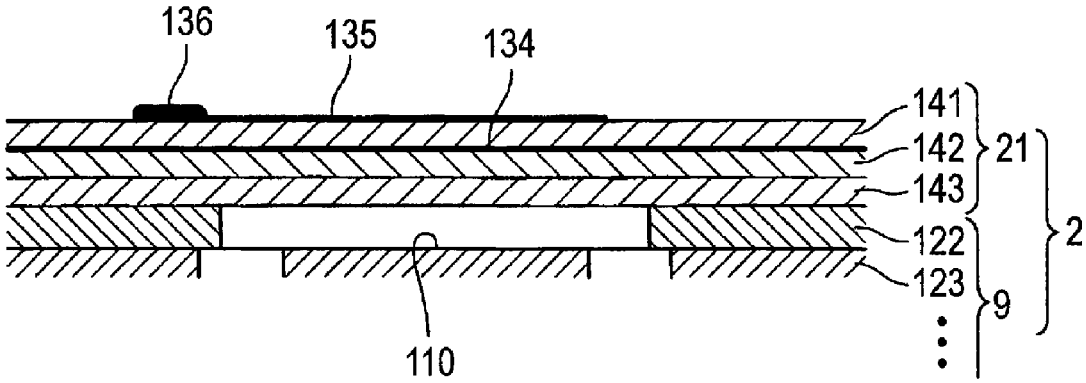
FIGS. 6A and 6B are views for explaining an actuator unit shown in FIG. 4.
Figure 6B:
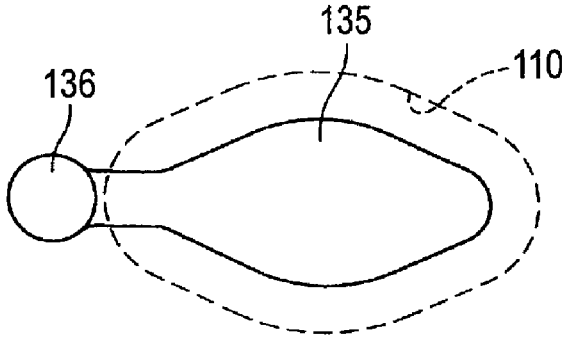

Next, the head unit 2 will be described referring to FIGS. 3 to 6. FIG. 3 is a plan view of the head unit 2. FIG. 4 is an enlarged view of a region surrounded by one-dot chain lines of FIG. 3. In addition, in FIG. 4, the actuator units 21 to be drawn by solid lines are drawn by broken lines, and pressure chambers 110, apertures 112, and ink ejection ports 108 that exist below the actuator units 21 and should be drawn by broken lines are drawn by solid lines. FIG. 5 is a cross-sectional view taken along the line V-V shown in FIG. 4. FIG. 6A is an enlarged cross-sectional view of an actuator unit 21, and FIG. 6B is a plan view showing an individual electrode disposed on the surface of the actuator unit 21 in FIG. 6A. In addition, although a thin adhesive layer 146 (see FIG. 10) exists between the actuator unit 21 and a cavity plate 122 so as to bond them, it is omitted in FIG. 6A.

As shown in FIG. 3, the head unit 2 includes the channel unit 9, and four actuator units 21 fixed to a top surface 9*a* of the channel unit 9. As shown in FIG. 4, ink channels including the pressure chambers 110 are formed inside the channel unit 9. The actuator units 21 include a plurality of actuators corresponding to the pressure chambers 110, respectively, and have a function to selectively impart ejection energy to the ink in the pressure chambers 110.

The channel unit 9 is formed in the shape of a rectangular parallelepiped that has almost the same shape in plan view as the plate 94 of the reservoir unit 71. In the top surface 9*a* of the channel unit 9, a total of ten ink supply ports 105*b* are formed in correspondence with the ink outflow channels 62 (see FIG. 2) of the reservoir unit 71. A manifold channel 105 that communicates with the ink supply ports 105*b*, and sub-manifold channels 105*a* that branch from the manifold channel 105 are formed inside the channel unit 9. As shown in FIGS. 4 and 5, the bottom surface of the channel unit 9 is an ink ejection surface 2*a* in which a number of ink ejection ports 108 are disposed in a matrix. A number of pressure chambers 110 are arrayed in a matrix similarly to the ink ejection ports 108, in the top surface of the channel unit 9.

In the present embodiment, 16 rows of the pressure chambers 110 are arrayed within one actuator unit 21. Each of the rows includes a plurality of pressure chambers 110 arranged at equal intervals and extends in the longitudinal direction of the channel unit 9. The number of pressure chambers 110 included in each pressure chamber row is larger closer to a long side (lower base) of the actuator unit 21 and is smaller closer to a short side (upper base) thereof. This is similarly applied to the ink election ports 108.

As shown in FIG. 5, the channel unit 9 includes nine metal plates of stainless steel, etc., including a cavity plate 122, a base plate 123, an aperture plate 124, a supply plate 125, three manifold plates 126, 127, and 128, and a cover plate 129, and a nozzle plate 130 in order from above. These plates 122 to 130 have a rectangular planar shape that is long in a main scanning direction. By registering and laminating these plates 122 to 130 on each other, a number of individual ink channels 132 that lead to the ink ejection ports 108 through the manifold channel 105, the sub-manifold channels 105*a*, the apertures 112 functioning as diaphragms from outlets of the sub-manifold channels 105*a*, and the pressure chambers 110 are formed in the channel unit 9.

Next, the actuator units 21 will be described. As shown in FIG. 3, each actuator unit 21 has a trapezoidal planar shape. Four actuator units 21 are alternately disposed in the main scanning direction so as to avoid the ink supply ports 105*b*. Parallel opposite sides of each actuator unit 21 extend along the longitudinal direction of the channel unit 9. Oblique sides of adjacent actuator units 21 overlap each other in the main scanning direction.

As shown in FIG. 6A, each actuator unit 21 includes a piezoelectric member in which three piezoelectric layers 141 to 143 made of a plumbum-zirconate titanate-based (PZT) ceramic material that has ferroelectricity are laminated. An individual electrode 135 is formed in a region of the top surface of a piezoelectric layer 141 as an uppermost layer, which faces a pressure chamber 110. Between the piezoelectric layer 141 as an uppermost layer and the underlying piezoelectric layer 142, a common electrode 134 that is formed on the whole sheet surface is interposed. As shown in FIG. 6B, the individual electrode 135 has a substantially rhomboidal shape in plan view, which is analogous to a pressure chamber 110. In plan view, most of the individual electrode 135 is within the region of the pressure chamber 110. One of acute angle portions in the substantially rhomboidal individual electrode 135 extends outward of the pressure chamber 110, and a circular individual land 136 electrically connected to the individual electrode 135 is provided at the tip of the acute angle portion. The individual land 136 is thicker than the individual electrode 135. Further, COM lands 138 and 139 (see FIGS. 8 and 9) electrically connected to the common electrode 134 are formed on the surface of the piezoelectric layer 141.

The common electrode 134 and the individual electrode 135 are connected to the driver IC 52 via wiring lines provided in the COF 50. A signal held at a ground potential is supplied to the common electrode 134 from the driver IC 52. A driving signal that takes a ground potential and a positive potential alternately according to an image pattern to be printed is supplied to the individual electrode 135 from the driver IC 52.

The piezoelectric layer 141 is polarized in its thickness direction. If an electric field is applied in a polarization direction to a portion (active portion) of the piezoelectric layer 141 that is sandwiched between the individual electrode 135 and the common electrode 134 so that the individual electrode 135 may have a potential different from the common electrode 134, the active portion will be distorted by a piezoelectric effect. For example, if the polarization direction and the applying direction of an electric field are the same, the active portion will shrink in a direction (in-plane direction) orthogonal to the polarization direction. On the other hand, the piezoelectric layers 142 and 143 are non-active layers that are not distorted spontaneously. At this time, since the piezoelectric layers 141 to 143 are fixed to the top surface of the cavity plate 122 that defines the pressure chamber 110, a uni-morph effect occurs. As a result, the regions of the piezoelectric layers 141 to 143 corresponding to the active portion deform so as to become convex toward the pressure chamber 110. As such uni-morph deformation occurs, pressure, i.e., ejection energy is applied to the ink in the pressure chamber 110, thereby ejecting ink droplets from an ink ejection port 108. As such, since the portion of the actuator unit 21 that is sandwiched between the individual electrode 135 and the pressure chamber 110 serves as an individual actuator, the same number of actuators as the number of pressure chambers 110 is formed in the actuator unit 21.

Figure 7:
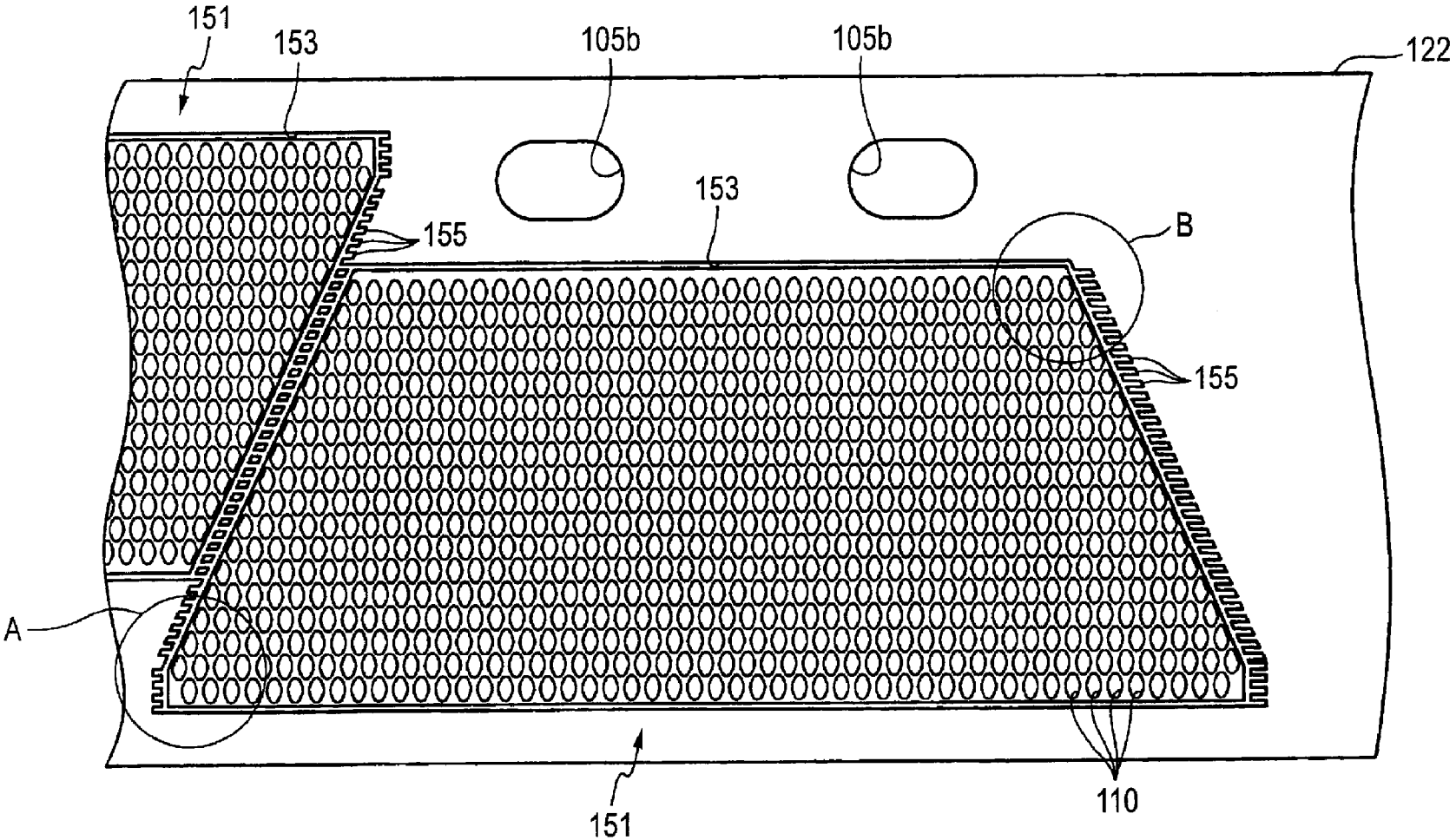
FIG. 7 is a plan view of a COF shown in FIG. 2.

Next, details of the cavity plate 122 will be described with reference to FIGS. 7 to 10. FIG. 7 is a partial plan view of the cavity plate 122. In the cavity plate 122, the pressure chambers 110 are formed as through holes. A number of pressure chambers 110 formed in the cavity plate 122 form four pressure chamber groups 151 (only two of them appear within the range shown in FIG. 7) that have the same trapezoidal shape as one another. Each of the pressure chamber groups 151 has almost the same dimension as the actuator unit 21.

Four annular grooves 153 that have a trapezoid frame shape and surrounds the four pressure chamber groups 151, respectively, are formed in the cavity plate 122. Each of the annular groove 153 is formed as a recessed portion that does not pass through the cavity plate 122. A number of rectangular grooves 155 (each of which serves as an example of a second groove) extend from both oblique sides of the annular groove 153. The rectangular groove 155 has a side wall surfaces in parallel with a short side and a long side of the trapezoid shape of the annular groove 153, and the rectangular groove are relatively short length. All the rectangular grooves 155 are connected with the annular groove 153. A number of the rectangular grooves 155 are formed at equal intervals. A number of the rectangular grooves 155 that extend from two facing oblique sides related to two adjacent annular grooves 153 are connected with each other at their tips. The annular groove 153 and the rectangular grooves 155 are formed by performing half-etching of masking portions other than the annular groove and rectangular grooves on the cavity plate 122.

Figure 8:
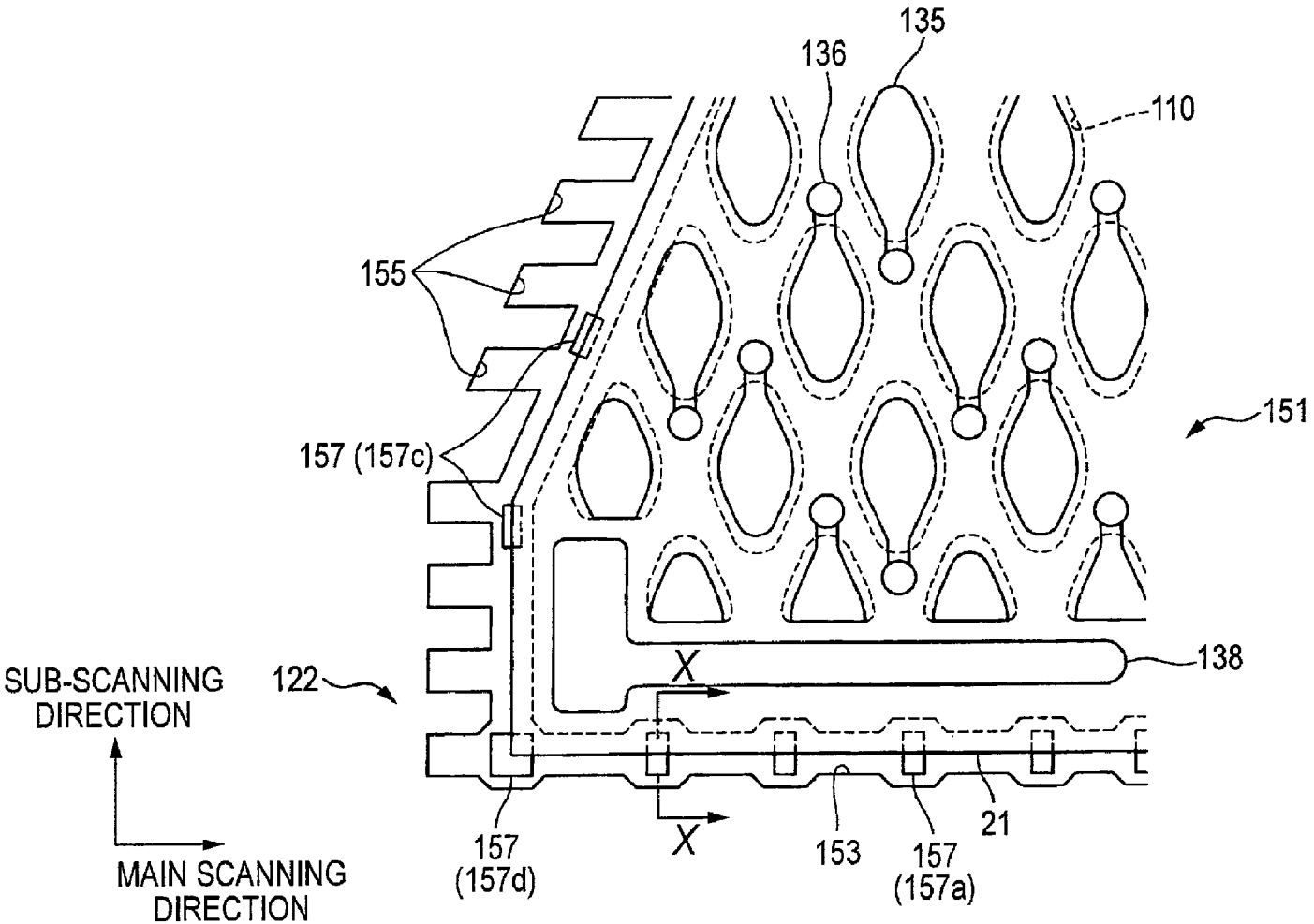
FIG. 8 is an enlarged plan view of a region A shown in FIG. 7.
Figure 9:
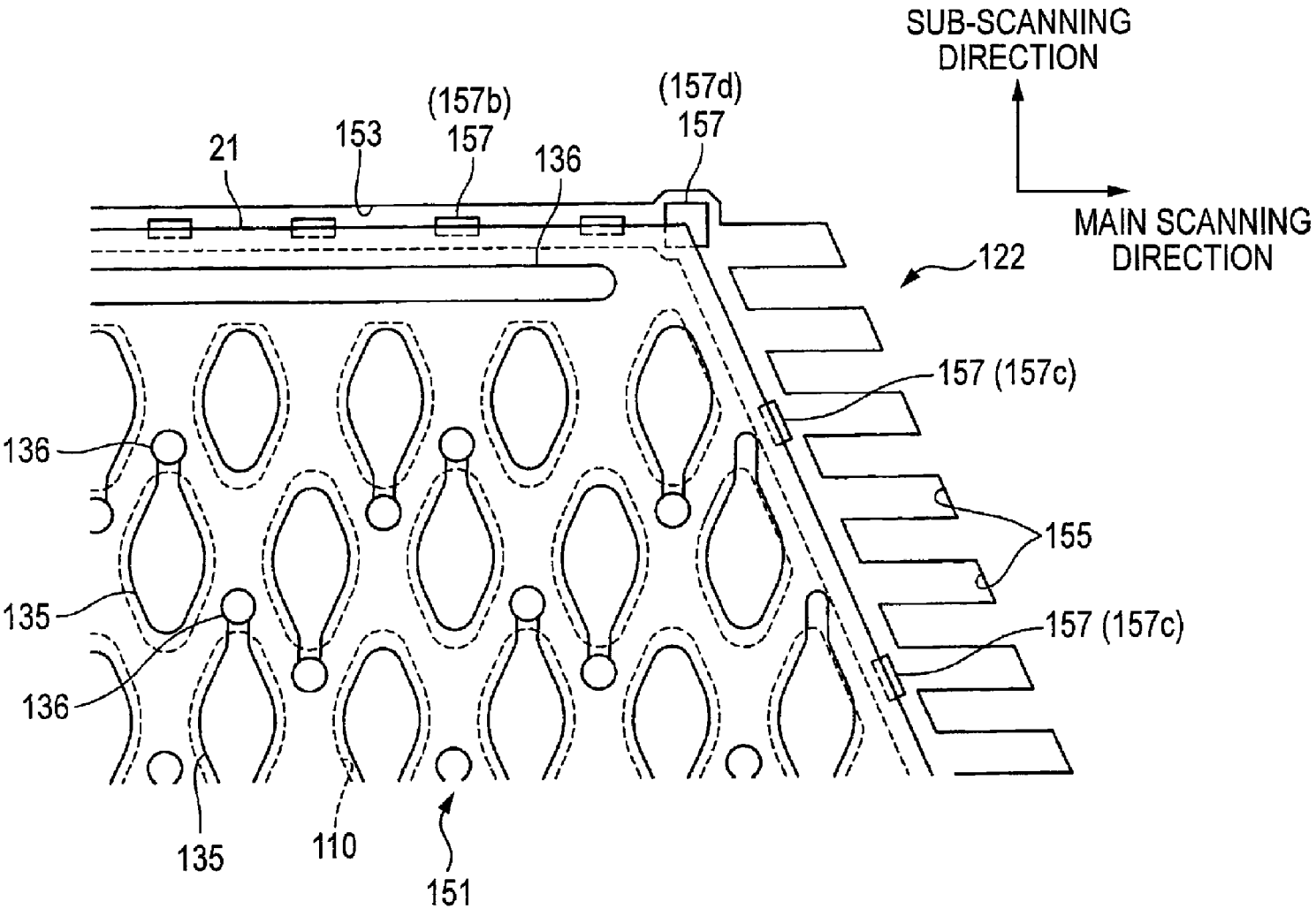
FIG. 9 is an enlarged plan view of a region B shown in FIG. 7.
Figure 10:
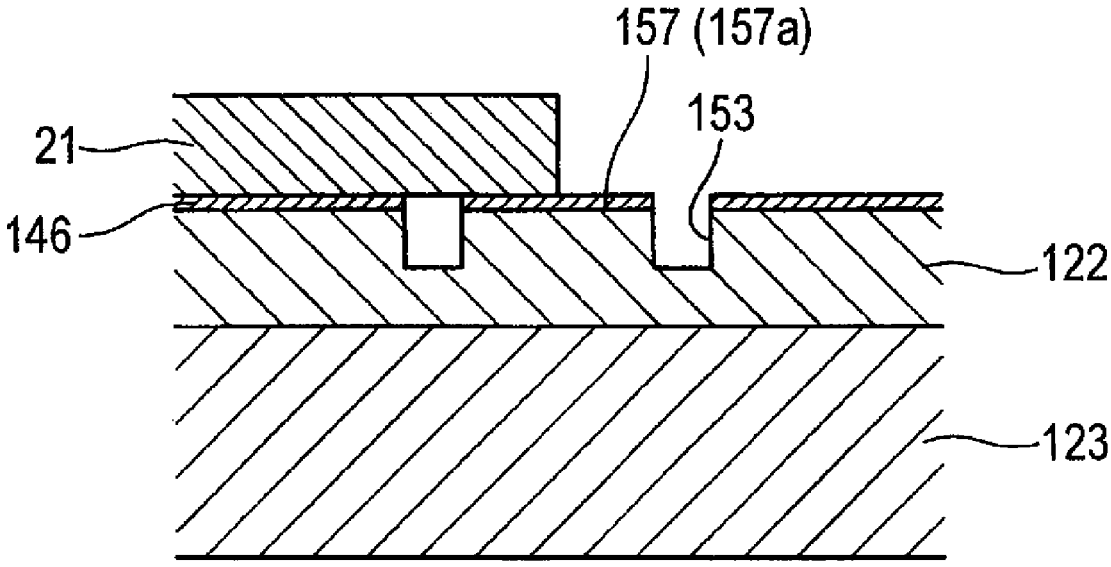
FIG. 10 is a cross-sectional view taken along the line X-X shown in FIG. 7.

FIGS. 8 and 9 are respectively enlarged plan views of a region A and a region B shown in FIG. 7, in a state where the actuator unit 21 is disposed on the cavity plate 122. FIG. 10 is a cross-sectional view taken along the line X-X shown in FIG. 8. In FIG. 10, illustration of the laminated structure of the actuator unit 21 is omitted. As shown in FIGS. 8 to 10, an outer edge of a bottom surface of the actuator unit 21 faces the annular groove 153 over the entire periphery of the actuator unit. In addition, in FIGS. 7 to 9, the pressure chambers and individual electrodes that are drawn at the outermost periphery of the actuator unit 21 are formed as dummies that do not perform ink ejection.

A number of supporting columns 157 (each of which serves as an example of supporting portion) project from the bottom surface of the annular groove 153. The supporting columns 157 are portions of the cavity plate 122. The supporting columns 157 includes supporting columns 157*a* that are formed along a long side of the annular groove 153, supporting columns 157*b* that are formed along a short side of the annular groove 153, supporting columns 157*c* that are formed along oblique sides of the annular groove 153, and supporting columns 157*d* that are formed at four corners of the annular groove 153. All the supporting columns 157 are arranged along the extending direction of the annular groove 153 while facing the outer edge of the bottom surface of the actuator unit 157. Also, all the supporting columns 157 are provided in the shape of islands that are spaced apart from inner and outer wall surfaces of the annular groove 153. Since the height of the supporting columns 157 is the same as the depth of the annular groove 153, as shown in FIG. 10, the supporting columns 157 adhere tightly to the actuator unit 21 via the adhesive layer 146 that bonds the actuator unit 21 and the cavity plate 122. Thereby, the supporting columns 157 support the actuator unit 21 from below. The supporting columns 157 are formed simultaneously with the annular groove 153 and the rectangular grooves 155 by masking portions corresponding to the supporting columns 157 during etching when the annular groove 153 and the rectangular grooves 155 are formed in the cavity plate 122.

A number of the supporting columns 157*a* provided at the long side of the annular groove 153 are disposed at equal intervals. Further, a number of the supporting columns 157*b* provided at the short side of the annular groove 153 are disposed at the same equal intervals as the supporting columns 157*a*. A number of the supporting columns 157*c* provided at the oblique sides of the annular groove 153 are disposed at equal intervals that are different from the supporting columns 157*a*.

The supporting columns 157*a* have a rectangular shape that is long in the sub-scanning direction in plan view. Therefore, even if the actuator unit 21 deviates in position in the sub-scanning direction due to manufacturing errors, the possibility that the outer edge portion of the bottom surface of the actuator unit 21 faces the supporting columns 157*a* is high. That is, the allowable error of the positional deviation of the actuator unit 21 in the sub-scanning direction with respect to the channel unit 9 is large.

The width of the annular groove 153 at the long side thereof is larger around the supporting columns 157*a* as the other places by recessing the outer and inner wall surfaces of the annular groove inward and outward, respectively. This prevents the supporting columns 157*a* from being connected with the inner wall surface or outer wall surface of the annular groove 153, and thereby from being no longer islands, due to manufacturing errors.

In the manufacturing process of an ink-jet head having the above structure, when the cavity plate 122 and the actuator unit 21 are bonded, adhesive overflowing from between both the cavity plate and the actuator unit flows into the annular groove 153. At this time, most of a side surface of the actuator unit 21 is apart from boundaries of the cavity plate and actuator unit. Therefore, the amount of the adhesive that climbs up the side surface of the actuator unit 21 and adheres to the top surface of the actuator unit 21 decreases. Accordingly, poor ejection that occurs as the adhesive adheres to the top surface of the actuator unit 21 is suppressed. The adhesive also flows into the rectangular grooves 155 connected with the annular groove 153. Therefore, the amount of the adhesive that climbs up the side surface of the actuator unit 21 decreases significantly. Further, since the rectangular grooves 155 are formed in an elongate shape in the main scanning direction, when an adhesive is sequentially transferred onto the top surface of the cavity plate 122 along its longitudinal direction, the rectangular grooves 155 accommodate the adhesive. Thus, most of each oblique side of the annular groove 153 is embedded with the adhesive. Consequently, since a lot of adhesive flow into the annular groove 153 when the cavity plate 122 and the actuator unit 21 are bonded, the amount of the adhesive that climbs up the side surface of the actuator unit 21 further decreases.

Further, in the present embodiment, the supporting columns 157 that face the outer edge portion of the bottom surface of the actuator unit 21 support the actuator unit 21. Thus, when the actuator unit 21 is bonded to the channel unit 9 via an adhesive, a pressing force applied to the actuator unit 21 will be applied to the supporting columns 157 via the actuator unit 21. Therefore, a shear force acting on the actuator unit 21 becomes considerably small, and cracks are hardly generated in the actuator unit 21. Further, since the outer edge portion of the bottom surface of the actuator unit 21 faces the annular groove 153, an adhesive hardly adhere to the top surface of the actuator unit 21 over its entire periphery.

Moreover, the supporting columns 157 are provided in the shape of islands that are spaced apart from the inner and outer wall surfaces of the annular groove 153. Thus, at the time of bonding the channel unit 9 and the actuator unit 21, the adhesive applied to portions other than the supporting columns 157 of the top surface of the cavity plate 122 does not adhere to the supporting columns 157 separated from the portions by the annular groove 153. Thus, the adhesive more hardly adhere to the top surface of the actuator unit 21.

In the ink-jet head according to the present embodiment, at the time of bonding the channel unit 9 and the actuator unit 21, the supporting columns 157 will adhere tightly to the bottom surface of the actuator unit 21 via an adhesive. Thus, within a range in which the actuator unit 21 adheres tightly to the supporting columns 157, an adhesive can climb up the side surface of the actuator unit 21 and arrive at the top surface thereof. Like the present embodiment, by arranging a plurality of supporting columns 157 along an extending direction of the annular groove 153 within the annular groove 153, the dimension of each of the supporting columns 157 can be made small. Thus, an adhesive hardly adheres to the top surface of the actuator unit 21. Moreover, cracks can be hardly generated within a wider range of the actuator unit 21 where a plurality of supporting columns 157 are disposed.

Also, since a plurality of supporting columns 157 are disposed at equal intervals at the long side, short side, oblique sides of the annular groove, the number of the supporting columns 157 can be a significantly small number close to a lowest number that cracks are not generated in the actuator unit 21. Accordingly, an adhesive more hardly adhere to the top surface of the actuator unit 21.

Further, in the ink-jet head of the present embodiment, the actuator unit 21 has a trapezoidal shape and the supporting columns 157*d* face the corners of the actuator unit 21. This prevents cracks from being generated at corners where cracks are apt to be generated.

Second Embodiment

Figure 11:
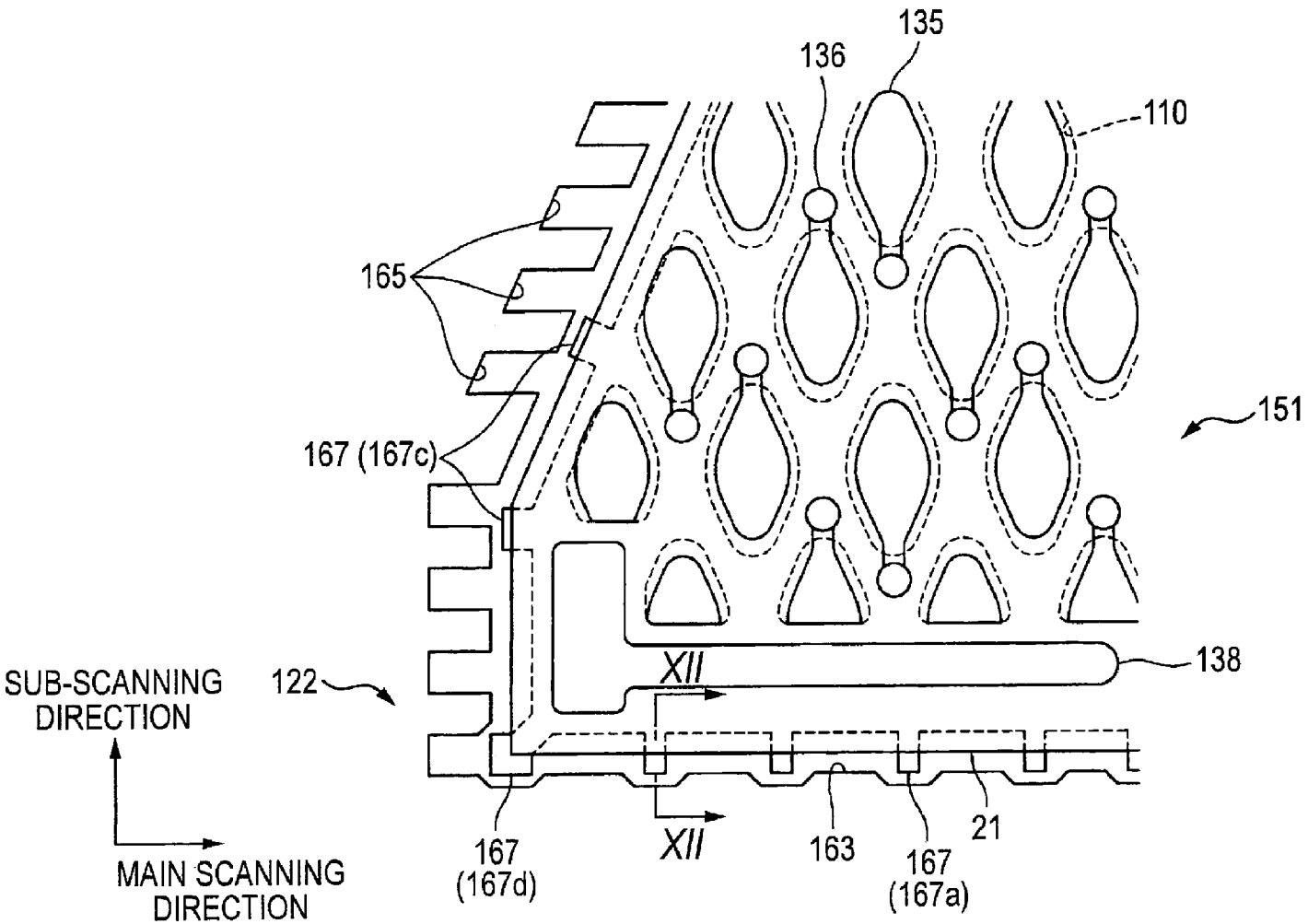
FIG. 11 is a plan view corresponding to FIG. 8, of an ink-jet head according to a second embodiment of the invention.
Figure 12:
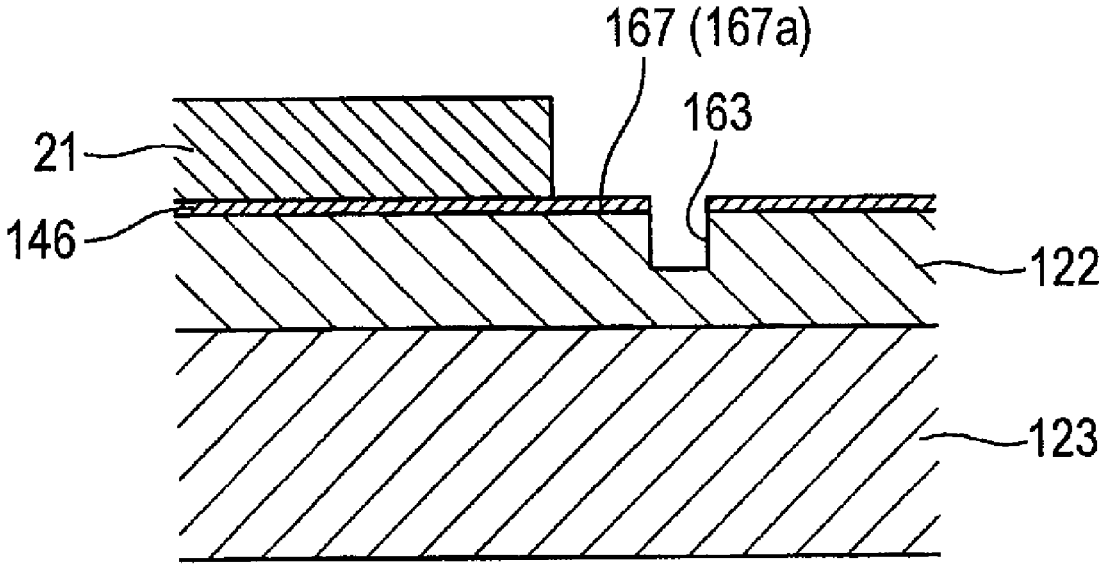
FIG. 12 is a cross-sectional view taken along the line XII-XII shown in FIG. 11.

Next, a second embodiment of the invention will be described with reference to FIGS. 11 and 12. FIG. 11 is a plan view corresponding to FIG. 8, of an ink-jet head according to the second embodiment of the invention. FIG. 12 is a cross-sectional view taken along the line XII-XII shown in FIG. 11. The present embodiment is different from the first embodiment only in that supporting portions are connected with the inner wall surface of an annular groove, and are not provided in the shape of islands. Accordingly, description about portions that are duplicated with those of the first embodiment is omitted.

As shown in FIG. 11, even in the present embodiment, four annular grooves 163 that have a trapezoid frame shape and surrounds the four pressure chamber groups 151, respectively, are formed in the cavity plate 122 (a portion of one annular groove 163 of the annular grooves is drawn in FIG. 11). A number of rectangular grooves 165 that are parallel to a short side and a long side and are relatively short extend from both oblique sides of the one annular groove 163. All the rectangular grooves 165 are connected with the annular groove 163.

An outer edge portion of the bottom surface of the actuator unit 21 faces the annular groove 163 over the entire periphery of the actuator unit. A number of supporting projections 167 (each of which serves as an example of a supporting portion) project toward the outside the annular groove 163 from the inner wall surface of the annular groove 163. The supporting projections 167 are connected with the bottom surface of the annular groove 163. The supporting projections 167 are portions of the cavity plate 122. The supporting projections 167 do not reach the outer wall surface of the annular groove 163, and do not close the annular groove 163.

The supporting projections 167 includes supporting projections 167*a* that are formed along a long side of the annular groove 163, supporting projections (not shown) that are formed along a short side of the annular groove 163, and supporting projections 167*c* that are formed along oblique sides of the annular groove 163, and supporting columns 167*d* that are formed at four corners of the annular groove 163. All the supporting projections 167 are arranged along the extending direction of the annular groove 163 while facing the outer edge portion of the bottom surface of the actuator unit. Since the height of the supporting projections 167 is the same as the depth of the annular groove 163, as shown in FIG. 12, the supporting projections 167 adhere tightly to the actuator unit 21 via the adhesive layer 146. Thereby, the supporting projections 167 support the actuator unit 21 from below.

A number of the supporting projections 167*a* provided at the long side of the annular groove 163 are disposed at equal intervals. Further, a number of the supporting projections provided at the short side of the annular groove 163 are disposed at the same equal intervals as the supporting projections 167*a*. A number of the supporting projections 167*c* provided at the oblique sides of the annular groove 163 are disposed at equal intervals that are different from the supporting projections 167*a*.

The supporting projections 167*a* have a rectangular shape that is long in the sub-scanning direction in plan view. Therefore, even if the actuator unit 21 deviates in position in the sub-scanning direction due to manufacturing errors, the possibility that the outer edge portion of the bottom surface of the actuator unit 21 faces the supporting projections 167*a* is high. That is, the allowable error of the positional deviation of the actuator unit 21 in the sub-scanning direction with respect to the channel unit 9 is large.

The width of the annular groove 163 at the long side thereof is larger around the supporting projections 167*a* as the other places by recessing the outer wall surface of the annular groove outward. This prevents the supporting projections 167*a* from being connected with the outer wall surface of the annular groove 163 due to manufacturing errors.

Even according to the present embodiment, by providing the supporting projections 167*a* in the annular groove 163, cracks are hardly generated in the actuator unit 21 at the time of bonding the channel unit 9 and the actuator unit 21. In addition, the same effects as those of the first embodiment can be obtained, except for the fact that the supporting projections 167 are not provided in the shape of islands.

Third Embodiment

Figure 13:
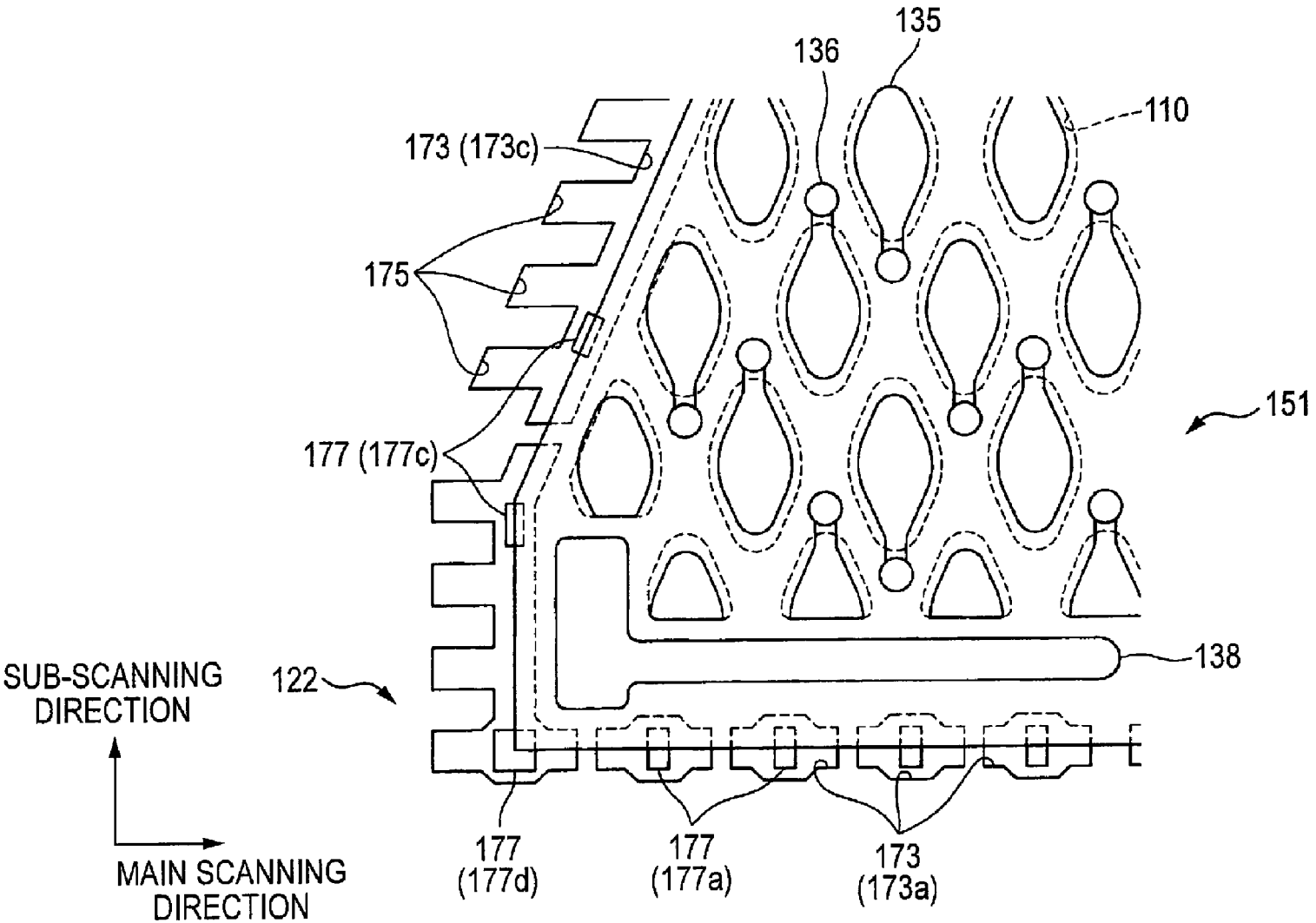
FIG. 13 is a plan view corresponding to FIG. 8, of an ink-jet head according to a third embodiment of the invention.

Next, a third embodiment of the invention will be described with reference to FIG. 13. FIG. 13 is a plan view corresponding to FIG. 8, of an ink-jet head according to the third embodiment of the invention. The present embodiment is different from the first embodiment only in that a groove that surrounds a pressure chamber group is not an annular groove. Accordingly, description about portions that are duplicated with those of the first embodiment is omitted.

As shown in FIG. 13, even in the present embodiment, four pressure chamber groups 151 that are formed in the cavity plate 122 are surrounded by a plurality of peripheral grooves 173, respectively (some of the peripheral grooves in one of the pressure chamber groups are drawn in FIG. 13). The peripheral grooves 173 include peripheral grooves 173*a* that are formed along a long side of the actuator unit 21, peripheral grooves (not shown) that are formed along a short side of the actuator unit 21, and peripheral grooves 173*c* that are formed along oblique sides of the actuator unit 21. A number of rectangular grooves 175 that are parallel to a short side and a long side of the actuator unit 21 and are relatively short extend from each of the peripheral grooves 173*c*. All the rectangular grooves 175 are connected with the peripheral groove 173*c*.

An outer edge portion of the bottom surface of the actuator unit 21 faces the peripheral grooves 173 over the entire periphery of the actuator unit except for between adjacent peripheral grooves 173. One or a plurality of supporting columns 177 (each of which serves as an example of a supporting portion) project from the bottom surface of each of the peripheral grooves 173. The supporting columns 177 are portions of the cavity plate 122. The supporting columns 177 includes supporting columns 177*a* that are formed within the peripheral grooves 173*a*, respectively, supporting columns (not shown) that are formed within the peripheral grooves formed along the short side of the actuator unit 21, and supporting columns 177*c* (excluding supporting columns that fall under supporting columns 177*d*) that are formed within the peripheral grooves 173*c*, and supporting columns 177*d* that are formed at four corners of the actuator unit 21. In each of the peripheral grooves 173*a*, only one supporting column 177*a* is formed. In addition, in the present embodiment, one supporting column 177*d* is within a peripheral groove 173*c*. However, the supporting column 177*d* may be formed within a peripheral groove 173*a*, or within a peripheral groove along the short side of the actuator unit 21.

All the supporting columns 177 face the outer edge portion of the bottom surface of the actuator unit 21. Also, all the supporting columns 177 are provided in the shape of islands that are spaced apart from inner and outer wall surfaces of the peripheral grooves 173. Since the height of the supporting columns 177 is the same as the depth of the annular grooves 173, the supporting columns 177 adhere tightly to the actuator unit 21 via the adhesive layer 146 that bonds the actuator unit 21 and the cavity plate 122. Thereby, the supporting columns 177 support the actuator unit 21 from below.

The supporting columns 177 are disposed at equal intervals at each of the long side, short side, and oblique sides of the actuator unit 21.

The supporting columns 177*a* have a rectangular shape that is long in the sub-scanning direction in plan view. Therefore, even if the actuator unit 21 deviates in position in the sub-scanning direction due to manufacturing errors, the possibility that the outer edge portion of the bottom surface of the actuator unit 21 faces the supporting columns 177*a* is high. That is, the allowable error of the positional deviation of the actuator unit 21 in the sub-scanning direction with respect to the channel unit 9 is large.

The width of the peripheral grooves 173*a* is larger around the supporting columns 177*a* as the other places by recessing the outer and inner wall surfaces of the peripheral grooves inward and outward, respectively. This prevents the supporting columns 177*a* from being connected with the outer or inner wall surfaces of the peripheral grooves 173*a* due to manufacturing errors.

Even according to the present embodiment, by providing the supporting columns 177 in the annular grooves 173, cracks are hardly generated in the actuator unit 21 at the time of bonding the channel unit 9 and the actuator unit 21. In addition, the same effects as those of the first embodiment can be obtained, except for the fact that the peripheral grooves 173 are not formed in an annular shape. Further, since a region where a pressure chamber group is formed, and a region outside the region are connected with each other in a plurality of places between adjacent peripheral grooves 173, degradation of the rigidity of the cavity plate 122 is suppressed as much.

As described above, in any of the embodiments, the actuator unit 21 is supported by the supporting columns 157 or 177 or supporting projections 167, and is fixed to the channel unit 9. When this is assembled into the ink-jet head 1, the individual lands 136 bonded to terminals of the COF 50 are formed on the individual electrodes 135 by a printing method. When the individual lands 136 are formed, a mask that has openings is disposed on the actuator unit 21, and conductive paste is transferred onto the individual electrodes 135 while the mask is moved along a squeegee. At this time, since the squeegee is moved in the longitudinal direction of the head, stress may be temporarily concentrated on corners or ends of the actuator unit 21. However, since the supporting columns 157 or 177 or supporting projections 167 support the actuator unit 21 from below, the actuator unit 21 is not damaged by concentration of a pressing force.

Although the embodiments of the invention have been described hitherto, the invention is not limited to the above embodiments, and various design changes can be implemented in the above embodiments within the scope set forth in the claims. For example, the actuator unit 21 may have planar shapes other than a trapezoidal shape. Further, the supporting portions may not face the corners of the actuator unit 21. Moreover, the supporting portions may not be portions of the cavity plate 122, and may be formed as separate portions (for example, portions of the base plate 123).

What is claimed is:

1. A liquid ejection head comprising:

a channel unit that comprises: a plurality of individual liquid channels each including a pressure chamber; and a first surface having a plurality of openings corresponding to a plurality of the pressure chambers; and a piezoelectric actuator unit having a second surface that is bonded to the first surface of the channel unit via an adhesive to cover the plurality of pressure chambers, wherein one or more grooves are formed in the first surface of the channel unit to surround the plurality of pressure chambers, wherein an outer edge portion of the second surface the piezoelectric actuator unit faces the groove, and wherein a supporting portion that faces the outer edge portion of the second surface of the piezoelectric actuator unit to support the piezoelectric actuator unit is provided in the groove.

2. The liquid ejection head according to claim 1, wherein the supporting portion has an island shape that is spaced from a side wall surface of the groove.

3. The liquid ejection head according to claim 1, wherein the groove has an annular shape to surround the plurality of the pressure chambers.

4. The liquid ejection head according to claim 1, wherein a plurality of the supporting portions are arranged along an extending direction of the groove within the groove.

5. The liquid ejection head according to claim 4, wherein the plurality of supporting portions are disposed at equal intervals.

6. The liquid ejection head according to claim 1, wherein the piezoelectric actuator unit has a polygonal shape, and the supporting portion faces a corner portion of the second surface of the piezoelectric actuator unit.

7. The liquid ejection head according to claim 1, wherein the supporting portion has a first length along an extending direction of the groove and a second length orthogonal to the extending direction, and wherein the second length is larger than the first length.

8. The liquid ejection head according to claim 1, wherein the supporting portion is connected to a side wall surface of the groove.

9. The liquid ejection head according to claim 1, wherein the groove has an inner wall surface; and an outer wall surface arranged across the inner wall surface from the pressure chambers, wherein a part of at least one of the inner wall and the outer wall has a recessed portion, and wherein the supporting portion is disposed in a portion of the groove corresponding to the recessed portion.

10. The liquid ejection head according to claim 1, wherein the groove has an inner wall surface; and an outer wall surface arranged across the inner wall surface from the pressure chambers, and wherein a second groove is formed to be connected to the outer wall surface of the groove and to extend in a direction away from the pressure chambers.

11. The liquid ejection head according to claim 10, wherein the second groove extends substantially along a longitudinal direction of the channel unit in plan view.

12. The liquid ejection head according to claim 1, wherein a height of the supporting portion and a depth of the groove is substantially same.

* * * * *